US009376755B2

(12) United States Patent
Bibber

(10) Patent No.: US 9,376,755 B2
(45) Date of Patent: Jun. 28, 2016

(54) METHOD AND COMPOSITION FOR ELECTROLESS NICKEL AND COBALT DEPOSITION

(71) Applicant: SANCHEM, INC., Chicago, IL (US)

(72) Inventor: John W. Bibber, Chicago, IL (US)

(73) Assignee: Sanchem, Inc., Chicago, IL (US)

( * ) Notice: Subject to any disclaimer, the term of this patent is extended or adjusted under 35 U.S.C. 154(b) by 364 days.

(21) Appl. No.: 13/909,455

(22) Filed: Jun. 4, 2013

(65) Prior Publication Data

US 2014/0353160 A1 Dec. 4, 2014

(51) Int. Cl.

| | |
|---|---|
| ***C23C 18/18*** | (2006.01) |
| ***C23C 18/34*** | (2006.01) |
| ***C23C 18/16*** | (2006.01) |
| ***C23C 18/54*** | (2006.01) |

(52) U.S. Cl.

CPC ..... *C23C 18/34* (2013.01); *C23C 18/1651* (2013.01); *C23C 18/1844* (2013.01); *C23C 18/54* (2013.01)

(58) Field of Classification Search

CPC .. C23C 18/34; C23C 18/1834; C23C 18/1637
USPC ..... 106/1.22, 1.27
See application file for complete search history.

(56) References Cited

U.S. PATENT DOCUMENTS

| | | | | | |
|---|---|---|---|---|---|
| 3,096,182 | A | | 7/1963 | Berzins | |
| 3,338,726 | A | | 8/1967 | Berzins | |
| 4,407,869 | A | * | 10/1983 | Mallory | C23C 18/34 106/1.22 |
| 5,258,061 | A | * | 11/1993 | Martyak | C23C 18/34 106/1.22 |
| 5,269,838 | A | * | 12/1993 | Inoue | C23C 18/34 106/1.22 |
| 5,718,745 | A | * | 2/1998 | Itoh | C23C 18/34 106/1.22 |
| 2004/0235237 | A1 | * | 11/2004 | Inoue | C23C 18/34 438/232 |
| 2007/0066059 | A1 | * | 3/2007 | Chen | C23C 18/34 438/678 |
| 2008/0254205 | A1 | * | 10/2008 | Petrov | C23C 18/34 427/99.5 |
| 2012/0156387 | A1 | * | 6/2012 | Stark | C23C 18/34 106/1.27 |

FOREIGN PATENT DOCUMENTS

| | | | |
|---|---|---|---|
| EP | 2270255 | * | 1/2011 |
| GB | 785695 | * | 11/1957 |
| WO | WO 2011/003116 A2 | * | 1/2011 |

* cited by examiner

*Primary Examiner* — Helene Klemanski
(74) *Attorney, Agent, or Firm* — Joseph T. Leone, Esq.; DeWitt Ross & Stevens S.C.

(57) ABSTRACT

An electroless plating bath composition of matter and corresponding method are described. The plating bath is an aqueous solution including an amino acid having at least one amino moiety and at least one carboxylic acid moiety or a polypeptide thereof, and having a molar ratio of amino moieties to carboxylic acid moieties of 1 or greater, a nickel-containing or a cobalt-containing salt, and a boron-containing reducing agent. The composition of matter is used in a method of electroless nickle-boron and cobalt-boron coating of substrates.

5 Claims, No Drawings

METHOD AND COMPOSITION FOR ELECTROLESS NICKEL AND COBALT DEPOSITION

FIELD OF THE INVENTION

Described herein is a method and corresponding composition of matter for improved cobalt-boron and nickel-boron electroless plating baths.

BACKGROUND

Cobalt-boron and nickel-boron plating baths have been in use since Talivaldis Berzins filed the first U.S. patent application on this type of process on Oct. 1, 1958, which matured into U.S. Pat. No. 3,096,182, issued Jul. 2, 1963. Conventional plating baths are generally used for making depositions on iron and iron alloy substrates. Most of these plating baths use sodium borohydride ($NaBH_4$) as the source of boron. The Berzins patent and others typically recite process temperatures of from 60° C. to 100° C., at pH's of about 12 to 13 or higher. Baths of this type deposit nickel-boron or cobalt-boron alloys with a boron content of 3.5% to 6.0%. As a result, the coatings are very hard. They are used extensively on gun barrels and in many applications requiring a hard, scratch-resistant surface. Since the Berzins patent, a number of improvements have been patented, but there has been a strict adherence to maintaining the bath at a pH of from 12 to 14, and at temperatures of no less than 60° C. These conventional reaction conditions are echoed in the standard text on electroless nickel deposition techniques, "Electroless Plating Fundamentals and Applications," G.O. Mallory and J. B. Hajdu, eds., ©1991 William Andrew Press, ISBN 978-0815512776. The high pH is required to prevent the decomposition of the borohydride. The conventional elevated temperature range is required to achieve an acceptably fast deposition rate. Iron and its alloys exhibit passivity at a high pH which counteracts the deposition. Additionally, absent adding catalysis to the bath (such as thallium and/or organic sulfur compounds) the maximum observed deposition rate is only about 0.0001 inch (2.54 μm) per hour at over 90° C. (See Mallory & Hajdu, supra, at page 82.). Thallium, however, is quite toxic and also plates out with the deposited nickel or cobalt. The co-deposited thallium imparts undesirable physical and chemical properties to the ultimate coating, as lower hardness, increased brittleness, and lower corrosion resistance.

To obtain a higher rate of deposition and a coating free of impurities introduced via a catalyst, amine-boranes came into use in the late 1960's. See U.S. Pat. No. 3,338,726, issued Aug. 29, 1967 to Berzins. The resulting deposited coatings contain less than 3.5% boron, deposit at higher rates, rate, may be used at temperatures as low as 40° C. and are conventionally used at pH's of about 6.0 to 9.5. The more mild deposition conditions also allow these types of baths to deposit onto aluminum and aluminum alloy substrates. They are used extensively in the electronics industry because the deposits may be soldered. However, due to the high cost of the amine-boranes, the baths are much more expensive to use. There are also adverse environmental issues associated with their use.

SUMMARY OF THE INVENTION

Disclosed and claimed herein are methods and corresponding compositions for improved electroless nickel-cobalt-boron plating. In the method, any soluble borohydride salt may be used with the preferred salt being sodium borohydride. Other suitable salts include lithium borohydride, potassium borohydride, and the like.

More specifically, the method comprises operating the plating bath at temperatures in the range of from about 60° F. to about 110° F. (about 15.5° C. to about 43.3° C.) with the preferred temperature being about 70° F. (about 21.1° C.) and in a pH range of about 10.5 to about 11.5 with the preferred pH being about 11.2. This pH range significantly reduces the passivity of iron and iron alloy substrates. The low temperature range significantly increases the stability of the borohydride salt being used. The borohydride concentration is maintained in the range of from about 0.100 to about 1.5 grams per liter of water with the preferred initial concentration being about 0.700 grams per liter of water.

Stabilization agents to prevent the nickel or cobalt from forming boride or hydroxide precipitates include a sufficient amount ammonia to form the corresponding ammonia cobalt- and/or ammonia nickel-coordinated complexes (optional) and a sufficient amount of an amino acid as defined herein. The amount of added stabilization agent should be sufficient to coordinate with the cobalt and/or nickel present in the bath to prevent precipitation when the plating bath is adjusted to the final pH. (Typically, the pH is pushed upward by adding alkali metal hydroxides to the plating bath.)

Any soluble nickel-containing or cobalt-containing salt may be used as long as the salt has no adverse effect upon the operation of the plating bath. The preferred nickel or cobalt salt being a halide; chloride is most preferred. The preferred concentration of the salt preferably yields a metal concentration of between about 0.02 to about 10.0 grams of nickel or cobalt per liter of plating bath.

The plating baths are constructed by dissolving the nickel or cobalt salts in mineral-free water, adding the ammonia (if used), then dissolving the amino acid in the bath. The preferred amino acid is glycine. The pH is then adjusted to the desired level. This can be done by any means now known or developed in the future. Typically this is done by adding an alkali metal hydroxide to the plating bath. The preferred alkali metal is potassium. The solution is the stirred to dissolve any nickel or cobalt hydroxides initially generated by adding the alkali metal hydroxide. The solution is then filtered to remove any precipitates. The borohydride is dissolved in an alkaline, aqueous solution and added to the bath. This procedure is followed to inhibit any initial rapid decomposition of the borohydride. Over the course of the reaction, the borohydride is consumed. As the borohydride in the bath is consumed, more is added, again dissolved in an aqueous, alkaline solution. As a general proposition, more than about 1.5 grams of borohydride per liter of solution will cause decomposition of the bath. Borohydride concentrations less than about 0.1 gram per liter are generally too low to give economical reduction rates of the nickel and cobalt ions.

Thus, disclosed and claimed herein is an electroless plating bath composition. The composition comprising an an aqueous solution including an amino acid having at least one amino moiety and at least one carboxylic acid moiety or a polypeptide thereof, having a molar ratio of amino moieties to carboxylic acid moieties of 1 or greater; a nickel-containing or a cobalt-containing salt; and a boron-containing reducing agent.

The amino acid may be a molecule consisting of one (1) amino acid moiety and one (1) carboxylic acid moiety or the the amino acid may be is selected from the group consisting of alpha-amino acids and beta-amino acids. Preferred amino acids include, but are not limited to alanine, asparagine, arginine, cysteine, glutamine, glycine, histidine, isoleucine, lysine, leucine, phenylalanine, methionine, serine, proline, tryptophan, threonine, tyrosine, valine, pyrrolysine, and ornithine.

The boron-containing reducing agent preferably comprises a borohydride, such as sodium borohydride, lithium borohydride, or potassium borohydride.

Also disclosed herein is a process for depositing a nickel-boron or cobalt-boron coating on a substrate, typically a metallic substrate. The method comprises creating a galvanic cell on a surface of a metallic substrate and then contacting the metallic substrate with a plating bath as described hereinabove, wherein an electroless deposition reaction results, yielding a nickel-boron or cobalt-boron coating on the metallic substrate.

As used herein, the term "amino acid" means any compound, without limitation, that comprises at least one amino moiety and at least one carboxylic acid moiety, with the proviso that the molar quantity of amino moieties is equal to or greater than the molar quantity of carboxylic acid moieties, whether natural or unnatural, as well as polypeptides comprised of amino acids. That is, the molar ratio of amino groups to carboxylic acid groups in an "amino acid" as that phrase is defined herein must be 1 or greater. The amino moiety and carboxylic acid moiety need not be at the termini of the molecule. Thus, as used herein, the term "amino acid," explicitly encompasses natural and unnatural alpha amino acids, such as alanine, asparagine, arginine, cysteine, glutamine, glycine, histidine, isoleucine, lysine, leucine, phenylalanine, methionine, serine, proline, tryptophan, threonine, tyrosine, valine, pyrrolysine, ornithine, N-alkyl derivatives of the foregoing, and the like. The term "amino acid" also includes beta, gamma, and delta amino acids, and longer derivatives (i.e., β3 and β2 amino acids), homo-amino acids, proline and pyruvic acid derivatives, 3-substituted alanine derivatives, glycine derivatives, ring-substituted phenylalanine and tyrosine derivatives, linear core amino acids, diamino acids, D-amino acids, etc. The term "amino acid" also includes polypeptides comprising one or more amino acids as that term is defined herein, linked by peptidic bonds. Monomeric amino acids are generally preferred. A huge number of amino acids, natural and unnatural, are available commercially from numerous suppliers, such as Sigma-Aldrich (St. Louis, Mo.). The phrase "amino acid" excludes aspartic acid and glutamic acid because they have a molar quantity of carboxylic acid moieties larger than the molar quantity of amino groups (i.e., two carboxylic acid moieties per each amino moiety).

"Substrate" means any substrate, metallic or otherwise, susceptible to electroless plating as described herein, and explicitly including iron and its alloys, aluminum and its alloys, such as mild steel (i.e., low-carbon steels), carbon steels, aluminum alloys such as 6061 and other precipitation hardening aluminum alloys, titanium and its alloys, magnesium and its alloys, etc.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 1 to 9, from 3.6 to 4.6, from 3.5 to 9.9, and so forth.

All references to singular characteristics or limitations of the present invention shall include the corresponding plural characteristic or limitation, and vice-versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods of the present invention can comprise, consist of, or consist essentially of the essential elements and limitations of the method described herein, as well as any additional or optional ingredients, components, or limitations described herein or otherwise useful in synthetic organic chemistry.

DETAILED DESCRIPTION

The present inventor has found that amino acids having a ratio of amino moieties to carboxylic acid moieties of one (1) or greater are highly effective stabilization agents for nickel-boron and cobalt-boron electroless plating. Nickel-boron and cobalt-boron plating baths comprising an amino acid enable lower temperature electroless plating with excellent coating results and without the co-deposition of additional, unwanted metallic species. The method and plating baths disclosed are most easily described by representative examples. Note that the examples are representative and for illustrative purposes only. The examples do not limit the scope of the claims in any fashion.

The following examples illustrate the process when used on a steel substrate (i.e., an iron alloy substrate) and an aluminum substrate. In all of the examples using a steel substrate, mild steel pieces 1 inch×3 inch×0.125 inches thick (2.54 cm×7.62 cm×3.175 mm) was employed. Each substrate was first cleaned in a strong alkaline cleaner, rinsed in mineral-free water, and then dipped in a copper sulfate solution for few seconds to deposit a small amount of copper on the surface. The deposited copper creates a galvanic cell on the surface of the metal to initiate the electroless deposition process. The steel substrates were then rinsed in mineral-free water, then in an aqueous ammonia solution (pH 11.0), and immediately placed in the plating bath. Examples using aluminum substrates used 6061 aluminum. See the examples for additional details.

EXAMPLE 1

Glycine as Stabilization Agent

A mild steel sample, prepared as indicated above, was placed in a plating bath comprising:

- 7.5 grams per liter nickel (from nickel chloride)
- 5.0 grams per liter glycine
- 70 mL of 28% aqueous ammonia solution
- 100 mL of 1.0 N potassium hydroxide
- 0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.00025 inch (6.35 μm) per hour.

EXAMPLE 2

Alanine as Stabilization Agent

A mild steel sample, prepared as indicated above, was placed in a plating bath comprising:

- 7.5 grams per liter nickel (from nickel chloride)
- 5.0 grams per liter alanine
- 70 mL of 28% aqueous ammonia solution
- 100 mL of 1.0 N potassium hydroxide 0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.00021 inch (5.33 μm) per hour.

EXAMPLE 3

Valine as Stabilization Agent

A mild steel sample prepared as indicated above was placed in a plating bath comprising:

7.5 grams per liter nickel (from nickel chloride)
5.0 grams per liter valine
70 mL of 28% aqueous ammonia solution
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.00017 inch (4.318 μm) per hour.

EXAMPLE 4

Citric Acid as Potential Stabilization Agent

A mild steel sample, prepared as indicated above, was placed in a plating bath comprising:

7.5 grams per liter nickel (from nickel chloride)
5.0 grams per liter citric acid
70 mL of 28% aqueous ammonia solution
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. In this example, citric acid was used as a potential stabilization agent. Citric acid provides three (3) carboxylic acid groups per molecule, but no amine functionality. The reaction immediately started, giving off hydrogen gas from around the metal sample, but deposited no nickel metal on the steel substrate.

EXAMPLE 5

Aspartic Acid as Potential Stabilization Agent

A mild steel sample, prepared as indicated above, was placed in a plating bath comprising:

7.5 grams per liter nickel (from nickel chloride)
5.0 grams per liter aspartic acid
70 mL of 28% aqueous ammonia solution
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. In this example, the aspartic acid stabilization agent provides two (2) carboxylic acid moieties and one (1) amino moiety per molecule. The reaction immediately started, giving off hydrogen gas from around the metal sample, but deposited no nickel metal on the steel substrate.

EXAMPLE 6

Cobalt Deposition

A mild steel sample, prepared as indicated above, was placed in a plating bath comprising:

7.5 grams per liter cobalt (from cobalt chloride)
6.0 grams per liter glycine
70 mL of 28% aqueous ammonia solution
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-cobalt at the rate of 0.00028 inch (7.112 μm) per hour.

EXAMPLE 7

Low Temperature

A mild steel sample, prepared as indicated above, was placed in a plating bath comprising:

7.5 grams per liter nickel (from nickel sulfate)
5.0 grams per liter glycine
70 mL of 28% aqueous ammonia solution
100 mL of 1.0 N potassium hydroxide
0.70 grams per liter borohydride (from sodium borohydride)

The pH was 11.2 and the solution was maintained at 60° F. (15.5° C.) on a thermostat-controlled hot plate. The reaction immediately started and deposited boron-nickel at the rate of 0.00012 inch (3.048 μm) per hour.

EXAMPLE 8

Low Temperature

A mild steel sample, prepared as indicated above, was placed in a plating bath comprising:

7.5 grams per liter nickel (from nickel sulfate)
5.0 grams per liter glycine
70 mL of 28% aqueous ammonia solution
100 mL of 1.0 N potassium hydroxide
0.70 grams per liter borohydride (from sodium borohydride)

The pH was 11.2 and the solution was maintained at 50° F. (10.0° C.) on a thermostat-controlled hot plate. The reaction slowly started and deposited boron-nickel at the rate of 0.000024 inch (0.6096 μm) per hour.

EXAMPLE 9

High Temperature

A mild steel sample, prepared as indicated above, was placed in a plating bath comprising:

7.5 grams per liter nickel (from nickel sulfate)
5.0 grams per liter glycine
70 mL of 28% aqueous ammonia solution
100 mL of 1.0 N potassium hydroxide
0.70 grams per liter borohydride (from sodium borohydride)

The pH was 11.2 and the solution was maintained at 110° F. (43.33° C.) on a thermostat-controlled hot plate. The reaction immediately started and deposited boron-nickel at the rate of 0.00062 inch (15.748 μm) per hour.

EXAMPLE 10

High Temperature

A mild steel sample, prepared as indicated above, was placed in a plating bath comprising:

7.5 grams per liter nickel (from nickel sulfate)
5.0 grams per liter glycine
70 mL of 28% aqueous ammonia solution
100 mL of 1.0 N potassium hydroxide
0.70 grams per liter borohydride (from sodium borohydride)

The pH was 11.2 and the solution was maintained at 115° F. (46.11° C.) on a thermostat-controlled hot plate. The reaction immediately started but decomposed within half an hour.

EXAMPLE 11

Low pH

A mild steel sample, prepared as indicated above, was placed in a plating bath comprising:

7.5 grams per liter nickel (from nickel chloride)
5.0 grams per liter glycine
70 mL of 28% aqueous ammonia solution
0.70 grams per liter borohydride (from sodium borohydride)
pH adjusted to 10.0

The solution was maintained at 70° F. (21.11° C.) on a thermostat-controlled hot plate. Almost immediate decomposition of the sodium borohydride resulted.

EXAMPLE 12

Low pH

A mild steel sample, prepared as indicated above, was placed in a plating bath comprising:

7.5 grams per liter nickel (from nickel chloride)
5.0 grams per liter of glycine
70 mL of 28% aqueous ammonia solution
0.70 grams per liter borohydride (from sodium borohydride)
pH adjusted to 10.5

The solution was maintained at 70° F. (21.11° C.) on a thermostat-controlled hot plate. The reaction immediately started, and deposited 0.00041 inch (10.414 μm) over a 45 minute period of time at which point the borohydride was exhausted.

EXAMPLE 13

High pH

A mild steel sample, prepared as indicated above, was placed in a plating bath comprising:

7.5 grams per liter nickel (from nickel chloride)
5.0 grams per liter glycine
70 mL of 28% aqueous ammonia solution
0.70 grams per liter borohydride (from sodium borohydride)
pH adjusted to 11.5

The solution was maintained at 70° F. (21.11° C.) on a thermostat-controlled hot plate. The reaction immediately started, giving off hydrogen gas from around the metal sample, but deposited the layer only very slowly, 0.00005 inches (1.27 μm) per hour.

EXAMPLE 14

Aluminum Substrate

A 1 inch×3 inch×0.125 inch (2.54 cm×7.62 cm×3.175 mm) piece of 6061 alloy aluminum was cleaned and prepared as per ASTM B253 ("Standard Guide for the Preparation of Aluminum Alloys for Electroplating") for non-zincate electroless nickel applications and then placed in a bath comprising:

6.0 grams per liter nickel (from nickel chloride)
5.0 grams per liter glycine
70 mL of 28% aqueous ammonia
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.00012 inch (3.05 μm) per hour.

EXAMPLE 15

Aluminum Substrate

A 1 inch×3 inch×0.125 inch (2.54 cm×7.62 cm×3.175 mm) piece of 6061 alloy aluminum was cleaned and prepared as per ASTM B253 for non-zincate electroless nickel applications and then placed in a bath comprising:

3.9 grams per liter of cobalt (from the cobalt glycolic acid salt)
6.0 grams per liter glycine
70 mL of 28% aqueous ammonia
100 mL of 1.0 N potassium hydroxide
1.0 g of borohydride (from sodium borohydride)

The pH was 11.2 and the solution was maintained at 80° F. (26.66° C.) on a thermostat-controlled hot plate. The reaction immediately started and deposited boron-cobalt at the rate of 0.0005 inch (12.7 μm) per hour.

EXAMPLE 16

Magnesium Substrate

In addition to aluminum and its alloys, other light metals may be plated with the cobalt-boron and nickel-boron compositions described herein.

A 1 inch×3 inch×0.125 inch (2.54 cm×7.62 cm×3.175 mm) piece of AZ91D magnesium alloy was lightly glass bead blasted to remove an outer layer of oxide. (AZ91D is a well known and widely used magnesium alloy; it is used extensively for die casting metallic parts.) The piece was then placed in an aqueous, boiling 5% potassium hydroxide solution for two minutes, rinsed in mineral-free water and then placed in a dispersion of various polyamines and polyamides and made the anode of an electrochemical cell with the cathode being a 316 alloy stainless steel plate at about 15 amps per square foot for about three seconds. The substrate was then rinsed in a 1% aqueous ammonia solution to remove any polyamines or polyamides not chemically bounded to the substrate, rinsed in mineral-free water, and then placed in the following bath:

6.0 grams per liter nickel (from nickel gluconate)
5.0 grams per liter glycine
1.0 grams of citric acid
70 mL of 28% aqueous ammonia
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.006 inch (0.152 mm) per hour.

EXAMPLE 17

Magnesium Substrate

A 1 inch×3 inch×0.125 inch (2.54 cm×7.62 cm×3.175 mm) piece of AZ91D magnesium alloy was lightly glass bead blasted to remove an outer layer of oxide. (AZ91D is a well known and widely used magnesium alloy; it is used extensively for die casting metallic parts.) The piece was then placed in an aqueous, boiling 5% potassium hydroxide solution for two minutes, rinsed in mineral-free water and then placed in a dispersion of various polyamines and polyamides and made the anode of an electrochemical cell with the cathode being a 316 alloy stainless steel plate at about 15 amps per square foot for about three seconds. The substrate was then rinsed in a 1% aqueous ammonia solution to remove any polyamines or polyamides not chemically bounded to the substrate, rinsed in mineral-free water, and then placed in the following bath.

3.9 grams per liter cobalt (from cobalt gluconate)
5.0 grams per liter glycine
1.0 grams of citric acid
70 mL of 28% aqueous ammonia
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited cobalt-boron at the rate of 0.004 inch (0.102 mm) per hour.

EXAMPLE 18

Titanium Substrate

A 1 inch×3 inch×0.063 inch (2.54 cm×7.62 cm×1.6 mm) piece of Ti-6V titanium alloy was lightly glass bead blasted to remove an outer layer of oxide. The substrarte was then placed in an aqueous, boiling 5% potassium hydroxide solution for two minutes, rinsed in mineral-free water, and acid etched to remove the titanium oxides. The substrate was then rinsed in mineral-free water and placed in a polyamine/polyamide dispersion and made the anode for about three seconds. Excess polyamines and polyamines not bonded to the metal substrate were removed by rinsing in a 1% aqueous ammonia solution. The substrate was rinsed again in mineral-free water and placed in the following bath:

6.0 grams per liter nickel (from nickel gluconate)
5.0 grams per liter glycine
1.0 gram citric acid
70 mL of 28% aqueous ammonia
100 mL of 1.0 N Potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-nickel at the rate of 0.006 inch (0.152 mm) per hour.

EXAMPLE 19

Titanium Substrate

A 1 inch×3 inch×0.063 inch (2.54 cm×7.62 cm×1.6 mm) piece of Ti-6V titanium alloy was lightly glass bead blasted to remove an outer layer of oxide. The substrarte was then placed in an aqueous, boiling 5% potassium hydroxide solution for two minutes, rinsed in mineral-free water, and acid etched to remove the titanium oxides. The substrate was then rinsed in mineral-free water and placed in a polyamine/polyamide dispersion and made the anode for about three seconds. Excess polyamines and polyamines not bonded to the metal substrate were removed by rinsing in a 1% aqueous ammonia solution. The substrate was rinsed again in mineral-free water and placed in the following bath:

3.9 grams per liter cobalt (from cobalt gluconate)
5.0 grams per liter glycine
1.0 grams citric acid
70 mL of 28% aqueous ammonia
100 mL of 1.0 N potassium hydroxide
0.70 grams per liter borohydride (from sodium borohydride)

The pH was 11.2 and the solution was maintained at 70° F. (21.1° C.) on a thermostat-controlled hot plate. The reaction immediately started and deposited boron-cobalt at the rate of 0.004 inch (0.102 mm) per hour.

What is claimed is:

1. A process for depositing a nickel-boron or cobalt-boron coating on a metallic substrate, the method comprising:

(a) creating a galvanic cell on a surface of a metallic substrate;

(b) contacting the metallic substrate of step (a) with an aqueous solution comprising:

an amino acid having at least one amino moiety and at least one carboxylic acid moiety or a polypeptide thereof, having a molar ratio of amino moieties to carboxylic acid moieties of 1 or greater;

a nickel-containing or a cobalt-containing salt; and a boron-containing reducing agent selected from the group consisting of sodium borohydride, lithium borohydride, and potassium borohydride; and a pH of from about 10.5 to about 11.5;

at a temperature of greater than 10° C. (50° F.) to less than 46.11° C. (115° F.);

whereby an electroless deposition reaction results, yielding a nickel-boron or cobalt-boron coating on the metallic substrate.

2. The method of claim 1, comprising contacting the metallic substrate with the aqueous solution at a temperature of from about 15.5° C. to about 43.3° C. (about 60° F. to about 110° F.).

3. The method of claim 1, comprising contacting the metallic substrate with an aqueous solution comprising an amino acid molecule comprising at least one amino moiety and having only one (1) carboxylic acid moiety.

4. The method of claim 1, comprising contacting the metallic substrate with an aqueous solution comprising an amino acid having only one (1) amino acid moiety and having only one (1) carboxylic acid moiety.

5. The method of claim 4, comprising contacting the metallic substrate with the aqueous solution at a temperature of from about 15.5° C. to about 43.3° C. (about 60° F. to about 110° F.).

* * * * *